US005845801A

United States Patent [19]

Heitl

[11] Patent Number: 5,845,801

[45] Date of Patent: Dec. 8, 1998

[54] SAFETY SHIELD FOR POP TOP BEVERAGE CONTAINERS

[76] Inventor: Thomas L. Heitl, 1072 Goss Ave., Menasha, Wis. 54952

[21] Appl. No.: 987,029

[22] Filed: Dec. 9, 1997

[51] Int. Cl.[6] ..... B65D 17/34

[52] U.S. Cl. ..... 220/269; 220/730; 220/906

[58] Field of Search ..... 220/703, 719, 220/729, 730, 269, 253, 254, 258, 906

[56] References Cited

U.S. PATENT DOCUMENTS 4,901,877 2/1990 Hall .
5,054,640 10/1991 Tucker .
5,379,914 1/1995 Martins ..... 220/719
5,555,993 9/1996 Borkowski et al. ..... 220/269
5,617,970 4/1997 Lee ..... 220/730

*Primary Examiner*—Stephen K. Cronin
*Attorney, Agent, or Firm*—Russell L. Johnson

[57] ABSTRACT

A shield for a pop top beverage container that provides a barrier to foreign objects entering or exiting the container while permitting the flow of liquid from the container. The shield is formed of resilient and flexible material and is positioned adjacent to the inside of a shearable tab of a pop top container and secured there so that when the shear tab of the pop top is displaced inward into the container□it causes the shield to deflect inward to permit the shear tab to pass and there after, resiliently repositions itself so that it forms a liquid traversable barrier positioned in the opening created by the displacement of the shearable tab.

19 Claims, 4 Drawing Sheets

SAFETY SHIELD FOR POP TOP BEVERAGE CONTAINERS

BACKGROUND

Pop top beverage containers are ubiquitous world wide. Recyclable pop top beverage containers are seen as environmentally friendly. These containers are usually opaque and do not afford the user an opportunity to examine the fluid inside the container for foreign matter.

In most parts of the world, insects are a problem for at least a part of the year. It has been observed that some species of insects are attracted to the contents of many beverage containers. A number of these species are of the stinging varieties. The potential for a painful and sometimes fatal consequence of ingesting a stinging insect is sufficient to warrant precautions when appropriate.

The art has offered various caps and covers for the openings of beverage containers. Some serve their intended purposes well. None have met with great commercial success for numerous reasons; some related to the needs of the beverage industry, some related to the needs of the container manufacturer, some related to the consumer, and some related to recycling.

In order for the consumer to benefit from a barrier to things entering a pop top beverage container, the barrier should be available to the user at the time of need. This suggests that the barrier accompany the container and preferably be attached thereto. This in turn requires that the barrier not interfere with what is presently normal use of the pop top container. This also requires that the barrier not interfere with the recycling of the container.

Prior art external barriers are detectable by the user when drinking from the container which is seen as detracting from the enjoyment of drinking the beverage from the container. This suggests that the barrier be situated inside the container and be positioned in the container opening as a part of the function of opening of the container.

OBJECTIVES

It is an objective of this invention to provide a safety barrier for openings in pop top containers such that the barrier adds safety and convenience features to a pop top container without subtracting from the safety and convenience presently found in pop top containers.

It is further an objective of this invention to provide the barrier described above wherein the barrier is secured to the inside of the pop top container so that the barrier is positioned over the opening of the container in the regular process of opening the container.

It is further an object of this invention to provide a barrier as described above wherein the materials of construction of the barrier are compatible with the present processes of recycling pop top beverage containers.

It is further an object of this invention to provide the barrier as described above wherein the barrier is compatible with present processes for fabricating tops for pop top containers.

Other objects will be made apparent from the following specifications, drawings and claims.

PRIOR ART

The known prior art recognizes the need for a barrier that prevents insects and foreign matter from entering a pop top beverage container while permitting the free flow of the contents from the container.

The prior art, when viewed broadly, can be seen to pursue ends achieved by this invention but by different means operating in different modes.

U.S. Pat. No. 5,379,914 to Martins teaches a dome shaped screen riveted to the inside of the pop top container so as to permit the shearable tab to swing downward and to the side inside the dome.

U.S. Pat. No. 4,901,877 to Hall uses the pull tab of a pop top to press scored strips inward thereby creating a slotted opening in the top of the container.

U.S. Pat. No. 5,054,640 to Tucker teaches a cap that fits over the top of a container and has a hinged cover for a guarded opening.

U.S. Pat. No. 5,555,993 to Borkowski teaches the forming of a guarded opening in the pull tab of a pop top container and the pivoting of the guarded tab over the container opening to prevent the entry of foreign elements.

U.S. Pat. No. 5,617,970 to Lee teaches a separate apertured cover that is placed over the opening of a pop top container and engages the central rivet to maintain it in position in use.

BRIEF DESCRIPTION

The barrier of this invention is, a shield attached to the inside of the top of a pop top container and comprising; a substantially planer shield of flexible material attached to the inside of said top, said shield having an opening configured to span the opening of said top, said opening having barriers formed therein to prevent the passage of small objects there though, and said shield is resiliently deflectable by the shearable tab of said pop top during the process of opening said top and said shield will resiliently reposition itself over the opening formed when the shearable tab has passed from engagement with said shield thereby positioning said barrier over the opening.

DETAILED DESCRIPTION

Figure 1:
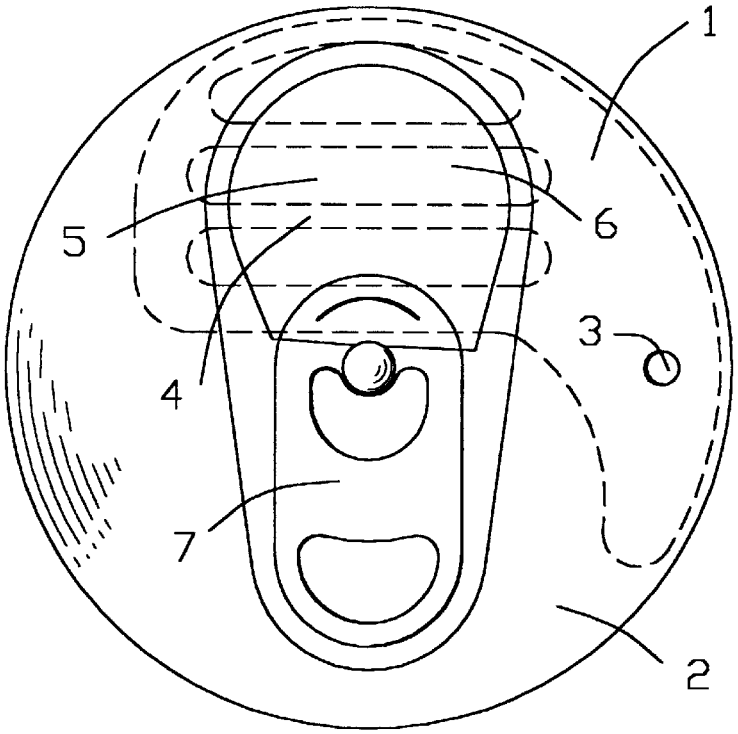
FIG. 1 is a plan view of the inside surface of a top of a pop top container having a shield made according to this invention secured thereto.

In the drawings like numbers refer to like objects and the proportions of some elements have been modified to facilitate illustration.

Figure 2:
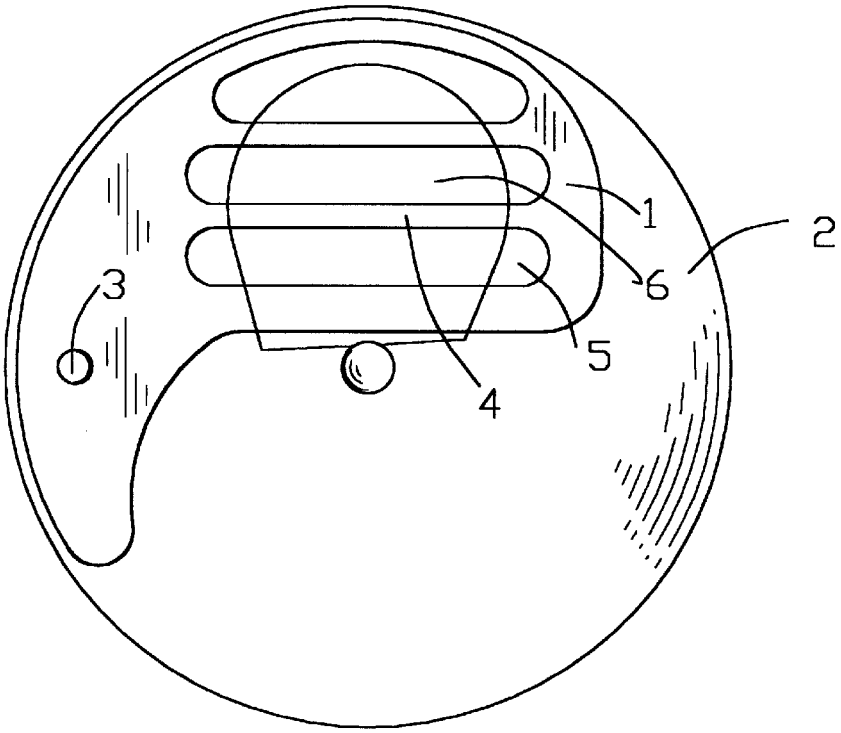
FIG. 2 is a plan view of the outside surface of the top of FIG. 1.
Figure 3:
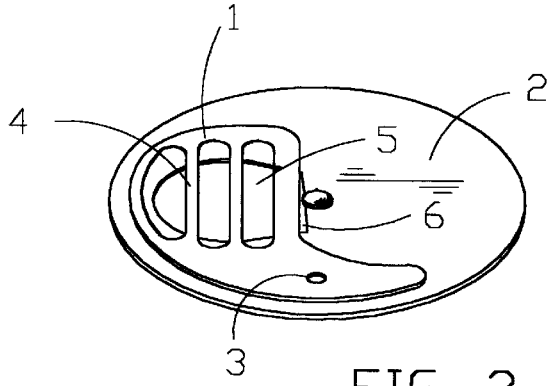
FIG. 3 is a perspective view of the top of FIG. 1.
Figure 4:
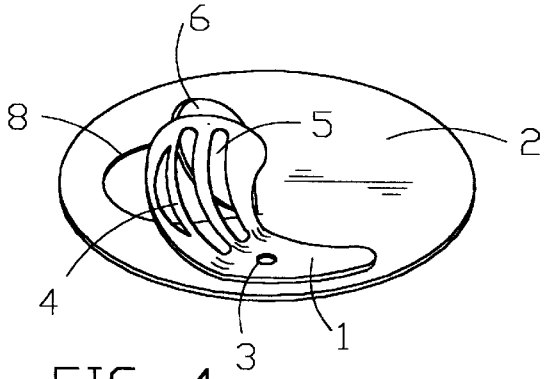
FIG. 4 is a perspective view of the top of FIG. 3 wherein a shearable tab formed in the top is shown to be resiliently deflecting a shield of this invention.
Figure 5:
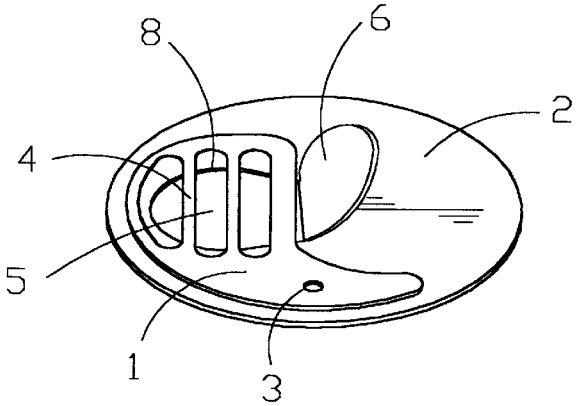
FIG. 5 is a perspective view of the top of FIG. 4 wherein the shearable tab is shown to have disengaged from the shield and the shield has resiliently repositioned itself over the opening created by the displacement of the shearable tab.
Figure 6:
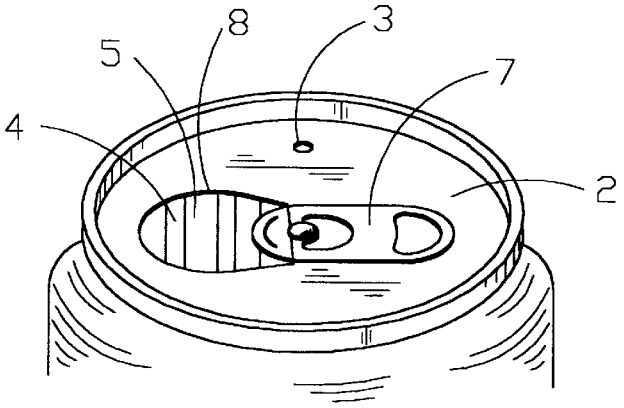
FIG. 6 is a perspective view of the outside surface of the top of FIG. 5 as it would appear on a beverage container.

Referring now to FIGS. 1 and 2 wherein a preferred embodiment of the shield of this invention is shown. It should be understood that because pop top containers vary in design, and that because the shield of this invention admits of an accommodating variability in design, and because the shield of this invention can be practiced with a range of materials and geometries, the best mode of practicing this invention will be application specific. Therefore the disclosures related to FIGS. 1 and 2 should be understood to represent a shield that is configured to cooperate with many of the more common geometries of pop top containers but not limiting of the scope of this invention.

In FIGS. 1 and 2 shield 1 is shown to be secured in place on the inside of top 2 of a pop top container by means of fastener 3.

Shield 1 may be of the same material as that of the container. For example; an aluminum alloy container and an aluminum alloy shield. Alternatively, shield 1 may be of a material that is different from that of the container but that is compatible with the processes used to recycle the container. For example; an aluminum alloy container and a shield formed of a thermoplastic material that will melt at a lower temperature than the aluminum alloy and become dross in the recycling process.

Fastener 3 in a preferred embodiment, is formed by a process similar to that used in the securing of a pull tab to the top of the pop top container. A post is formed as a part of the top and the post is passed through a hole in the shield. Thereafter, the end of the post is upset to form a rivit-like head that secures the shield to the top without breaching the continuity of the material of which the top is formed.

Alternatively fastener 3 may be formed of a food grade adhesive that will become dross during the recycling process.

Barrier 4 is here shown as a part of shield 1. Barrier 4 serves to bar the entry of foreign materials and agents larger than openings 5 in barrier 4 from entering or exiting the interior of a container.

As shown in FIGS. 1 and 2, and illustrated in FIGS. 3–6, shield 1 is positioned on the inside of top 2 so that barrier 4 underlies shearable tab 6. In use, when pull tab 7 is raised it causes shearable tab 6 to break free from top 2 and to be pressed inward so as to resiliently bend shield 1 downward and to the side. As shearable tab 6 approaches the full open position, it passes out of engagement with shield 1 and thereby permits shield 1 to resiliently reestablish its original position which now places barrier 4 across opening 8 which was formed by the displacement of shearable tab 6.

The above disclosures are enabling disclosures that teach a best mode of practicing the invention. However, the invention admits of a range of variance within the scope of the invention sufficient to encompass a range of materials, designs and combinations so as to permit the user to select the embodiment of the invention that is the best mode of practicing the invention for the specific application of the invention contemplated by the user.

FIGS. 7 through 10 are illustrative of variations and combinations of the elements of this invention that fall within the scope of inventive concepts of this invention.

Figure 7:
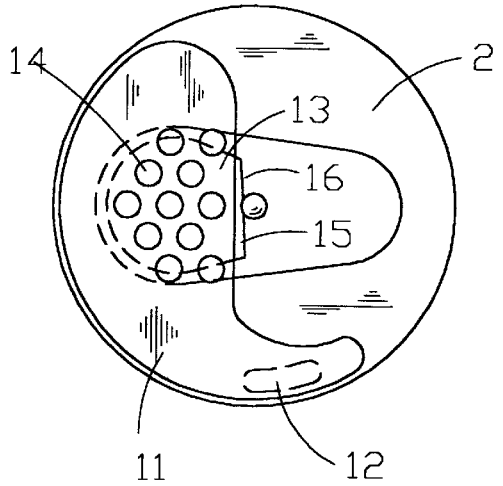
FIG. 7 is a plan view of a inside surface of a top for a pop top container having an embodiment of the shield of this invention secured thereto.

Referring now to FIG. 7 wherein shield 11 is shown to be secured to top 2 by means of adhesive island 12 and barrier 13 is shown to define circular shaped openings 14. It should be noted that in FIG. 7, shield 11 is provided with a shape that has portions that are too large to pass through the opening that would be created by the displacement of shearable tab 15. It should also be noted that hinge line 16 of shearable tab 15 is set at an angle to the longitudinal axis of shearable tab 15. It is common practice to slightly angle the hinge line of a shearable tab which causes the tab to pivot downward and to one side of the longitudinal center line of the shearable tab. It is useful in such conditions to position the securement means such as adhesive island 12 at a location opposite that towards which shearable tab 15 will swing. This permits shield 11 to be folded away from the direction in which tab 15 is folding and thereby permit disengagement at an earlier point in the opening of the pop top.

Figure 8:
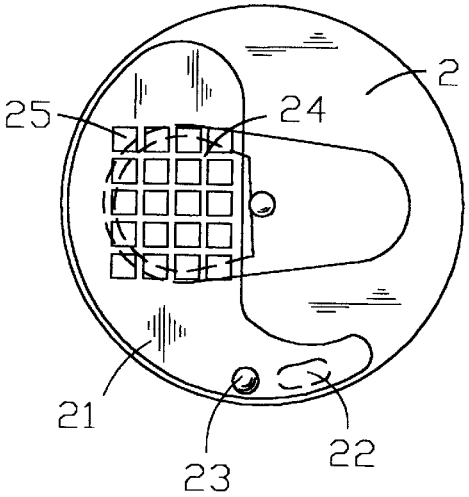
FIG. 8 is a plan view of a inside surface of a top for a pop top container having another embodiment of the shield of this invention secured thereto.

Referring now to FIG. 8 wherein shield 21 is shown to be secured to top 2 by means of an adhesive island 22 and a mechanical fastener 23. Shield 21 has formed therein barrier 24 which defines rectilinear openings 25 Redundant securement of the same or different types are of use in insuring that if one securement fails the shield will remain in place and functional.

Figure 9:
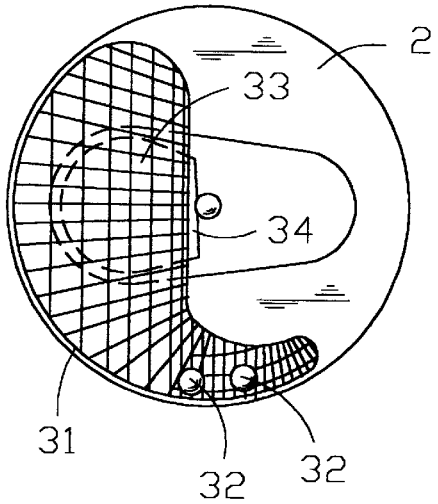
FIG. 9 is a plan view of a inside surface of a top for a pop top container having another embodiment of the shield of this invention secured thereto.

Referring now to FIG. 9 wherein shield 31 is shown to be secured to top 2 by means of securement 32 of the same type, here shown as mechanical fasteners. Shield 31 is here shown as a reticulated network of unevenly spaced strands so as to create a barrier that has irregularly distributed and spaced openings 33 underlying shearable tab 34. The capacity to provide irregularly sized and spaced openings to a shield provides the shield of this invention with the capacity to differentiate the flow of liquids through areas of a barrier.

Figure 10:
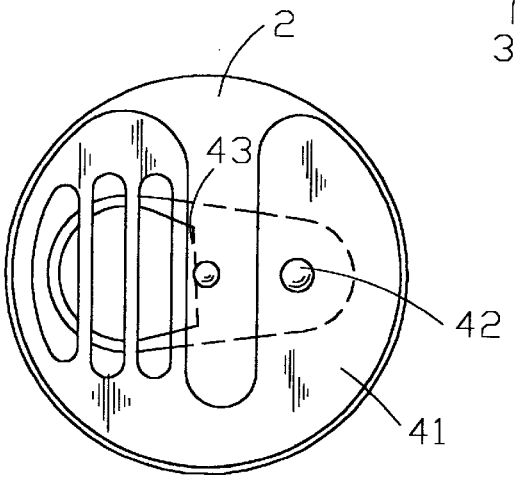
FIG. 10 is a plan view of a inside surface of a top for a pop top container having another embodiment of the shield of this invention secured thereto.

Referring now to FIG. 10 wherein shield 41 is secured to top 2 by means of a mechanical fastener 42. Mechanical fastener 42 is positioned on top 2 so as to underlie the pull tab associated with shearable tab 43. The capacity to be given a shape that permits the positioning of the securement means according to the needs of a situation is a utilitarian attribute of this invention.

Figure 11:
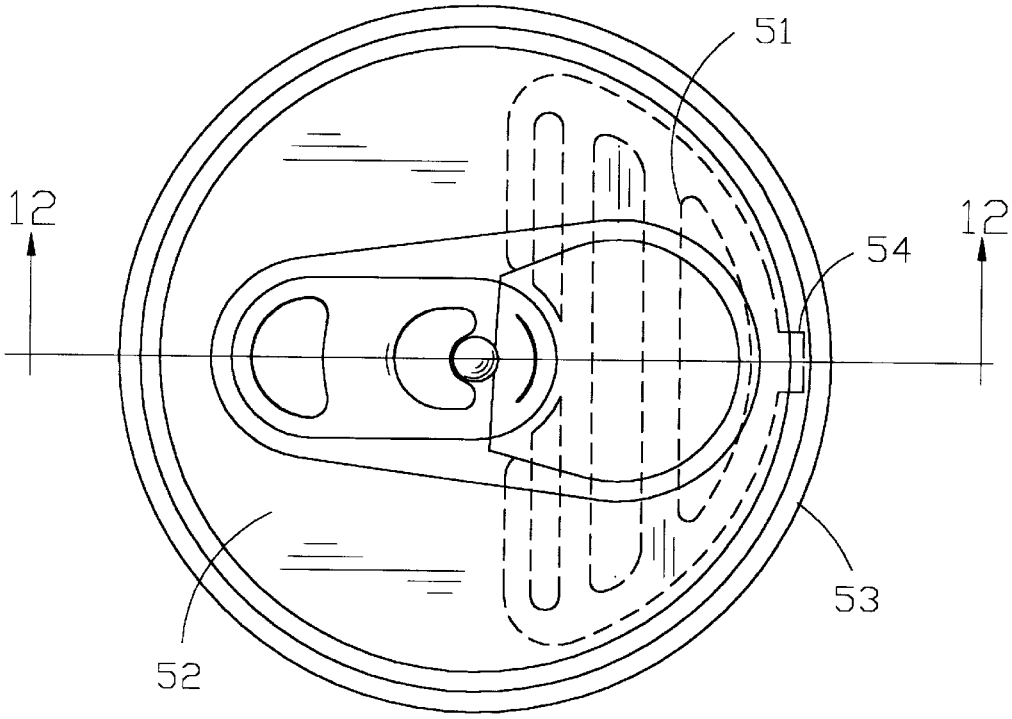
FIG. 11 is a plan view of a top for a pop top container having another embodiment of the shield of this invention secured thereto.
Figure 12:
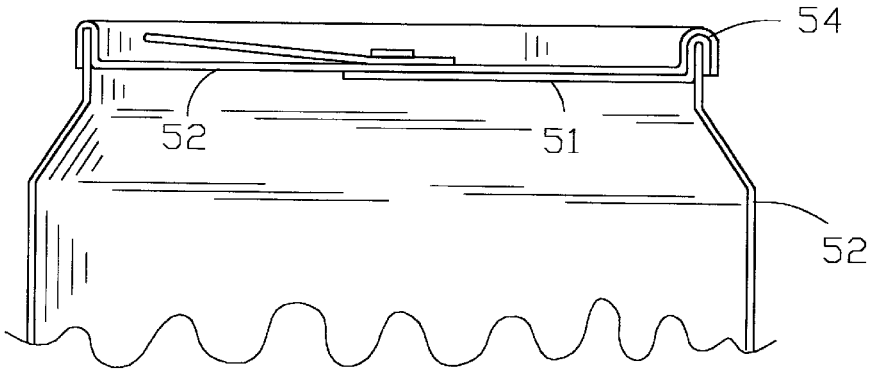
FIG. 12 is a sectioned elevational view of the embodiment of FIG. 11 taken along line 12—12 of FIG. 11.

Referring now to FIGS. 11 and 12 wherein shield 51 is shown to be attached at the perimeter of top 52 at top 52's intersection with container 53. Attachment tab 54 serves as a means for securing shield 51 in place and to provide the resilience for repositioning shield 51. The embodiment of FIGS. 11 and 12 is a further example of the variety of configurations and modes of operation that the shield of this invention can be given without departing from the scope of the invention.

FIGS. 1 through 12 are illustrative of the ranges of the elements, the shapes, the materials and the modes of operation that are within the scope of this invention without being exhaustive thereof. Therefore, the scope of this invention should not be seen as limited to that of the embodiments disclosed and illustrated, but rather the scope of this invention should only be limited to the scope of the appended claims and all equivalents thereto that would be made apparent to one skilled in the art.

What is claimed is:

1. A shield for an opening in a pop top container comprising;

a) a top for a pop top container, having a shearable tab as a part thereof and the the tab has a hinge line and, said top has an outside surface and an inside surface, b) a shield formed from a flexible sheet of degradable material having as a part thereof a barrier defining a multiplicity of openings, c) at least one securement means for hingably securing said shield to the inside surface of said top so as to position said barrier to underlay said shearable tab and to establish a hinge line in said shield such that when the shearable tab is pivoted downward along its hinge line to create an opening in said top, the shield is caused to pivot downward along its hinge line so as to permit said shearable tab to disengage from said shield and thereby free said shield to resiliently return to its original position with said barrier now positioned under the opening formed by the displacement of said shearable tab.

2. The shield of claim 1 wherein said shield has a portion thereof that is larger than the opening formed by the displacement of said shearable tab such that said shield cannot pass through said opening absent the forceful deformation of said shield.

3. The shield of claim 1 wherein said openings defined by said barrier are elongate.

4. The shield of claim 1 wherein said openings defined by said barrier are circular.

5. The shield of claim 1 wherein said openings defined by said barrier are rectilinear.

6. The shield of claim 1 wherein said openings defined by said barrier are irregular in their perimeter.

7. The shield of claim 1 wherein said securement means is adhesive.

8. The shield of claim 1 wherein said shield is formed of a metal.

9. The shield of claim 8 wherein said metal is an aluminum alloy.

10. The shield of claim 1 wherein said shield is formed of a thermally degradable material.

11. The shield of claim 10 wherein said thermally degradable material is a thermoplastic.

12. The shield of claim 1 wherein multiple securement means are used.

13. The shield of claim 12 wherein the securement means are of the same type.

14. The shield of claim 12 wherein the securement means are of different types.

15. The shield of claim 1 wherein said securement means is mechanical.

16. The securement means of claim 15 wherein said securement means is a securment tab located at the outside edge of said top.

17. The securement means of claim 15 wherein said securement means is formed as a part of said top without breaching the continuity of the material of which the top is formed.

18. The securement means of claim 17 wherein said securement means is a rivit-like securement.

19. A deflectable shield for an opening in a pop top container comprising;

a) a top for a pop top container, having a shearable tab as a part thereof and the the tab has a hinge line and, said top has an outside surface and a inside surface, b) a shield formed from a flexible sheet of degradable material having as a part thereof a barrier defining a multiplicity of openings, c) at least one mechanical securement means for hingably securing said shield to the inside surface of said top so as to position said barrier to underlay said shearable tab and to establish a hinge line in said shield such that when the shearable tab is pivoted downward along its hinge line to create an opening in said top, the shield is caused to pivot downward along its hinge line so as to permit said shearable tab to disengage from said shield and thereby free said shield to resiliently return to its original position with said barrier now positioned under the opening formed by the displacement of said shearable tab.

* * * * *